US010056047B2

(12) United States Patent
Aubert et al.

(10) Patent No.: US 10,056,047 B2
(45) Date of Patent: Aug. 21, 2018

(54) CONTROL OF AN ELECTROWETTING ELEMENT

(71) Applicant: Amazon Technologies, Inc., Seattle, WA (US)

(72) Inventors: Jozef Elisabeth Aubert, Roermond (NL); Henricus Petronella Maria Derckx, Weert (NL); Anthony John Slack, Lorgues (FR); Bokke Johannes Feenstra, Neunen (NL); Nicolas Eugene Bergeron, Stein (NL)

(73) Assignee: Amazon Technologies, Inc., Seattle, WA (US)

( * ) Notice: Subject to any disclaimer, the term of this patent is extended or adjusted under 35 U.S.C. 154(b) by 49 days.

(21) Appl. No.: 15/448,478

(22) Filed: Mar. 2, 2017

(65) Prior Publication Data

US 2017/0178575 A1 Jun. 22, 2017

Related U.S. Application Data

(63) Continuation of application No. 13/456,416, filed on Apr. 26, 2012, now Pat. No. 9,589,513, which is a (Continued)

(30) Foreign Application Priority Data

Oct. 29, 2009 (GB) ..... 0918959.8

(51) Int. Cl.
*G09G 3/34* (2006.01)

(52) U.S. Cl.
CPC ..... *G09G 3/348* (2013.01); *G09G 2320/0233* (2013.01); *G09G 2320/066* (2013.01); *G09G 2330/021* (2013.01)

(58) Field of Classification Search
CPC ..... G09G 3/348; G09G 2320/0233; G09G 2320/066; G09G 2320/021
See application file for complete search history.

(56) References Cited

U.S. PATENT DOCUMENTS 7,359,108 B2 4/2008 Hayes et al.
2004/0196525 A1* 10/2004 Fujii ..... G02B 26/005 359/245

(Continued)

FOREIGN PATENT DOCUMENTS

CN 1864197 A 11/2006
EP 2256719 A2 12/2010

(Continued)

OTHER PUBLICATIONS

Chen et al 2008 "An Accurate Gray-Level Driving Scheme for a Large-areaHigh-resolution Electrowetting Display".

(Continued)

*Primary Examiner* — Lisa Landis
(74) *Attorney, Agent, or Firm* — EIP US LLP

(57) ABSTRACT

A method of controlling an electrowetting element. The method includes receiving first data indicative of a first display effect. Using the first data, a first magnitude of a first voltage is determined. The first voltage with the first magnitude is generated and applied to the electrowetting element. Second data indicative of a second display effect different from the first display effect is received. Using the second data, a second magnitude of a second voltage is determined. The second magnitude is equal to the first magnitude. The second voltage with the second magnitude is generated and applied to the electrowetting element.

24 Claims, 4 Drawing Sheets

Related U.S. Application Data continuation of application No. PCT/EP2010/066412, filed on Oct. 28, 2010.

(56) References Cited

U.S. PATENT DOCUMENTS

| | | | | |
|---|---|---|---|---|
| 2008/0186581 | A1 | 8/2008 | Bita et al. | |
| 2008/0297030 | A1* | 12/2008 | Zhang | G02B 26/004 313/502 |
| 2009/0127123 | A1 | 5/2009 | Raccurt et al. | |
| 2010/0182290 | A1 | 7/2010 | Matsuoka et al. | |
| 2011/0025668 | A1 | 2/2011 | Huitema et al. | |
| 2012/0064643 | A1 | 3/2012 | Bawolek et al. | |

FOREIGN PATENT DOCUMENTS

| | | | |
|---|---|---|---|
| JP | 2007508576 | A | 4/2007 |
| JP | 2009204686 | A | 9/2009 |
| KR | 20060120006 | A | 11/2006 |
| WO | 2003071346 | A1 | 8/2003 |
| WO | 2005036517 | A1 | 4/2005 |
| WO | 2007057797 | A1 | 5/2007 |
| WO | 2007141218 | A1 | 12/2007 |
| WO | 2008119774 | A1 | 10/2008 |
| WO | 2008155926 | A1 | 12/2008 |
| WO | 2009004042 | A1 | 1/2009 |
| WO | 2009156431 | A1 | 12/2009 |

OTHER PUBLICATIONS

Van Dijk R et al 2006 68.3: Gray Scales for Video Applications on Electrowetting Displays.

* cited by examiner

CONTROL OF AN ELECTROWETTING ELEMENT

CROSS REFERENCE TO RELATED APPLICATIONS

This application is a continuation of U.S. patent application Ser. No. 13/456,416, filed on Apr. 26, 2012, which is a continuation of PCT/EP2010/066412, filed on Oct. 28, 2010, which claims priority to GB 0918959.8, filed Oct. 29, 2009. Application Ser. Nos. 13/456,416, PCT/EP2010/066412, and GB 0918959.8 are incorporated by reference in their entirety herein.

BACKGROUND

Electrowetting display devices are known. Hysteresis may be observed in electrowetting display devices. Hysteresis causes the electrowetting display to behave differently with an increase of applied voltage, compared with a decreasing voltage. Consequently, a display effect provided by the display may be inconsistent at a given voltage, depending on whether the applied voltage is reached from a lower or higher previous voltage. This is problematic for a display requiring reliable display states.

Pulse width modulation driving of an electrowetting pixel to only two extreme values; a pixel on value and a pixel off value, is known. Increasing the pulse width, i.e. increasing the pulse duration, increases the brightness of the pixel. Various gray scales can therefore be obtained by changing the pulse width. By driving the pixel to only the two extreme levels, hysteresis has no influence on the optical performance.

Using alternating current (AC) modulation to deal with hysteresis is known. Using AC requires twice the operating voltage than a direct current (DC) scheme; power consumption and operating costs are therefore higher, which is undesirable.

It is known to address the reproducibility of grayscales in electrowetting displays using AC pre-pulses before each greyscale state. For example, it is known to use a voltage signal, for example of zero volts, which is different from a data write signal and is used for preventing oil backflow. Neither of these approaches relate to the problem of hysteresis described above.

It is desired to overcome problems caused by hysteresis.

SUMMARY

In accordance with one aspect, there is provided a method of driving an electrowetting display device including a display element. In examples the display element comprises: a cavity; a first fluid and a second fluid within the cavity, the first fluid being immiscible with the second fluid, a surface facing the cavity; and a first electrode. In examples the display device comprises a control system for applying a voltage to the first electrode to provide a display state in response to a signal level of the voltage, wherein the control system is arranged to configure the signal level throughout a display period such that the second fluid adjoins at least a minimum area of the surface, the minimum area being greater than a zero area. In examples, the method comprises applying at least one display signal level during the display period, wherein said at least one display signal level is configured such that the first fluid and the second fluid adjoin the surface throughout the display period.

In devising the present method, it has been realized that hysteresis effects are caused by the response of the first and second fluids when driving the electrowetting display element starting from an off state; i.e. a configuration of the first and second fluids where only the first fluid adjoins the surface. Driving the display element from the off state to an on state where the first and second fluids adjoin the surface requires an applied voltage threshold initially to be overcome. In contrast, when the display element is already in an on state, further driving does not incur hysteresis effects when the second fluid adjoins at least the minimum area.

The display period is a time period throughout which at least one display state is provided by the display element, or a plurality of the display elements, for providing a display effect, for example an image, by application of at least one display signal level. With the control system arranged to configure the voltage signal level throughout the display period so the first and second fluids always adjoin the surface, the second fluid adjoins at least the minimum area. Thus, hysteresis effects may not interfere with the driving of the display element during the display period. A variety of greyscale display states may therefore be reliably and consistently provided, regardless of the previous voltage applied; this significantly improves the quality of images and image sequences displayable.

During the display period, the display element may be considered to have an always on, display state. In other words, the display element is continuously initiated, ready for a display state without hysteresis effects. Accordingly, the off state, i.e. an inactive state with a zero applied voltage, is not possible during the display period. Surprisingly, despite the off state being unavailable during the display period, a full range of display effects are available for providing high quality images. Example techniques for compensating the lack of the off state may be used and are described further below.

Electrowetting optical apparatus is known with a first surface and a second surface, the first surface having a different wettability for the first fluid than the second surface. Consequently, fluid motion in the apparatus has a preferential initiation when applying electrostatic forces. The present apparatus differs from this optical apparatus at least in the control system arrangement.

In embodiments, the method comprises applying at least one pre-display signal level during a pre-display period to initiate the display element for the display period. The pre-display period is a time period immediately preceding the display period. The at least one pre-display signal level is configured to meet or overcome the voltage threshold to initiate the display element, ready for the display period. In this way the display element is initiated for the display period, thereby being prepared for the display period so hysteresis effects do not affect switching during the display period.

In other embodiments, the at least one pre-display signal initiates the display element by changing a configuration of the display element from a state with the first fluid but not the second fluid adjoining the surface to a state with the first fluid and the second fluid adjoining part of the surface. Therefore, the at least one pre-signal level is configured to change the display element from the off state to a display state with the second fluid adjoining at least the minimum area, ready for the display period.

In further embodiments, the at least one pre-display signal level comprises a single signal level or a single signal pulse. In this way, a single signal level may be applied to the display element, being for example in the off state. Alternatively, one signal pulse may be applied, for example with the element in an off state, so the signal level is raised to a first pre-display signal level and then reduced to a second pre-display signal level. The single signal level, the first pre-display signal and the second pre-display signal level may be configured at least to meet and, in examples, exceed the voltage threshold required to initiate the display element.

In embodiments, the at least one pre-display signal level is configured to provide a signal level for an initial display state in the display period. The pre-display signal level may set the display element in the first display state of the display period. This combines initiation and the first display state of the display period, avoiding further addressing of the element in advance of the display period. For the example of the single signal pulse, the second pre-display signal level may therefore provide the first display state in the display period.

In further embodiments, the method comprises configuring the at least one pre-display signal level so that initiating the display element for the display period is imperceptible to a viewer of the display element. The timing and/or level of the pre-display state signal levels may be controlled so that a viewer cannot perceive the initiation. For example, the signal levels for the pre-display period and the display signal levels for the display period may be timed so the initiation is sufficiently long for initiation to occur, but sufficiently quick so the human eye cannot detect the initiation before the first display state is displayed in the display period.

In other embodiments, the method comprises controlling a timing and/or a signal level of the at least one display signal level so the first fluid and the second fluid adjoin the surface throughout the display period. The at least one display signal level applied throughout the display period may be controlled by the control system by way of timings, for example the duration and/or start and end timings of the display signal level(s), and/or the magnitude of the signal level(s), in order to maintain an initiated display element during the display period. In one embodiment, the display signal level may be dropped to zero volts but restored above zero volts, to the previous display signal level, sufficiently quickly. Thus, combined with the delay of the fluids to change configuration with a signal level change, the display element remains in a display state with the second fluid adjoining the surface. The zero volts may be applied sufficiently quickly such that the display state remains the same during the zero signal level. In this way, for example, a signal for reducing backflow can be applied whilst maintaining the display element in an initiated state.

In embodiments, the at least one display signal level is configured such that the second fluid adjoins at least 1%, 5% or 10% of the surface during the display period. Thus, the minimum area adjoined by the second fluid throughout the display period may be at least 1%, 5% or 10% of the total area of the surface. A minimum area of 1% or greater is easier to implement than a minimum area of less than 1%.

In other embodiments, the display element comprises a second electrode, the method comprising applying the at least one pre-display signal level during the pre-display period to the second electrode and applying the at least one display signal level during the display period to the first electrode. These embodiments implement the present method using two electrodes provided in the display element and adjacent to the surface. The pre-display signal level is applied to one electrode, this electrode for example being of a small area and located at a corner of the surface. The at least one display signal level for the display states in the display period is applied to the other electrode. Thus, electrode addressing for initiation and display state writing can be kept separate. This is less demanding for signal level sequences and frame rate timings for addressing the electrodes.

In embodiments, the method comprises applying a non-zero signal level to the second electrode throughout the display period. Thus, the display element may be initiated using a different electrode from the electrode receiving the at least one display signal level. This provides a simple method of addressing the display element.

The non-zero signal level may be configured so that the first and second fluids adjoin the surface throughout the display period. Thus the display element may remain initiated throughout the display period, even if a display signal level of zero volts on the first electrode is applied for longer than a response time of the fluids.

In embodiments, the applied voltage is a direct current voltage. Direct current (DC) requires a lower voltage than AC and requires less addressing instances of the display element by the control system, thus simplifying the signal level sequence applied to the at least one display element and maybe also the required frame rate. Using DC will therefore increase the lifetime of the display device and is easier than AC to combine with conventional scanning schemes for addressing display elements.

In accordance with a further aspect, there is provided a display device comprising: at least one display element comprising: a cavity; a first fluid and a second fluid within the cavity, the first fluid being immiscible with the second fluid, a surface facing the cavity; and a first electrode. In examples there is a control system for applying a voltage to the first electrode and providing a display state in response to a signal level of the voltage, wherein the control system is arranged, for at least one of said at least one display elements, to configure the signal level throughout a display period such that throughout the display period the first and second fluids adjoin the surface, the second fluid adjoining at least a minimum area of the surface, the minimum area being greater than a zero area. This display device may overcome problems caused by hysteresis throughout the display period.

In embodiments, the at least one display element comprises a second electrode, the control system being arranged to apply at least one pre-display signal level to initiate the display element for the display period, wherein the control system is arranged to apply the at least one pre-display signal level to the second electrode during a pre-display period and to apply the at least one display signal level to the first electrode during the display period. Such embodiments may have the effects of the embodiments described above, for simply initiating at least one display element throughout the display period.

In other embodiments the display device comprises more than one display element, wherein the first and/or the second electrodes of at least two of the display elements are electrically connected to the control system, and the control system is arranged to initiate simultaneously said more than one display elements. More than one display element may thus be initiated at the same time. For example, in such embodiments, the second electrodes of a plurality of display elements are connected to the control system, the control system being arranged to initiate simultaneously the plurality of display elements, the plurality of display elements being arranged as a line of display elements of the display device, or the plurality of display elements being all the display elements of the display device.

In further embodiments, the apparatus is arranged to reduce passage of radiation through a part of the surface adjoined by the second fluid after initiating the display. In embodiments where the first fluid absorbs light passing through the at least one display element, and with the second fluid adjoining at least the minimum area, radiation may pass through the display element through the area adjoined by the second fluid, without passing through the first fluid. This may negatively affect a display contrast-ratio, since the darkest display state allows radiation to pass through the display element. By reducing the passage of light through at least the minimum area, for example using a radiation absorbing part, the contrast-ratio may be improved. Further details of an example configuration are known to the skilled person.

Further, the display device comprises at least one test structure, the display device being arranged to initiate at least one display element using the at least one test structure. Accordingly, present embodiments may be applied to at least one display element using test structures present on a known matrix of display elements.

In another aspect there is provided a display device control system for controlling at least one display element comprising: a cavity; a first fluid and a second fluid within the cavity, the first fluid being immiscible with the second fluid, a surface facing the cavity; and a first electrode. The control system is for example arranged to apply a voltage to the first electrode and provide a display state in response to a signal level of the voltage. The control system is for example arranged, for at least one of said at least one display elements, to configure the signal level throughout a display period such that throughout the display period the first and second fluids adjoin the surface, the second fluid adjoining at least a minimum area of the surface, the minimum area being greater than a zero area. Any electrowetting display device fitted with the control system described herein may therefore avoid display problems from hysteresis effects.

Further features will become apparent from the following description of embodiments, given by way of example only, which is made with reference to the accompanying drawings, and which are now described in detail.

DETAILED DESCRIPTION

Figure 1:
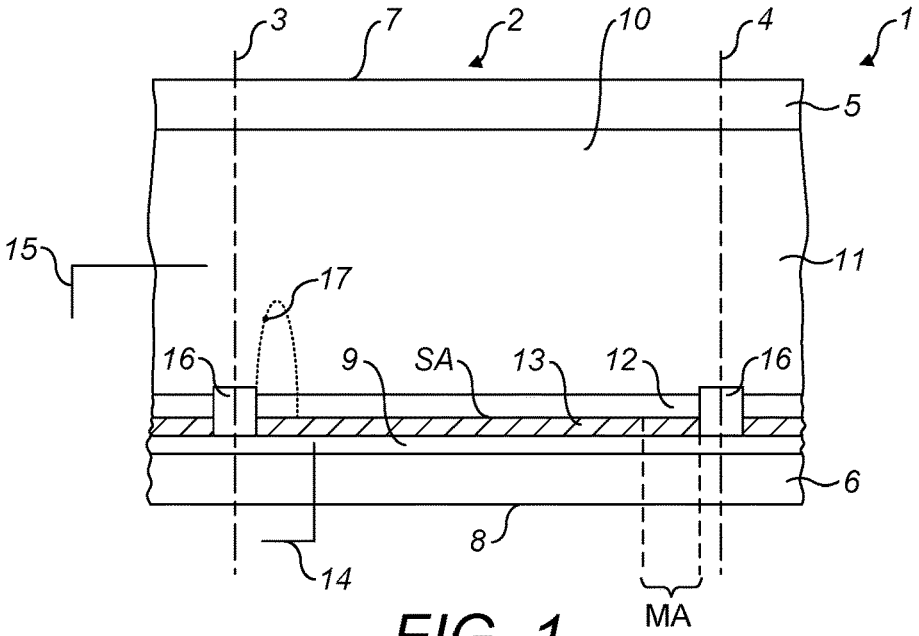
FIG. 1 shows schematically an electrowetting display element.

FIG. 1 shows a diagrammatic cross-section of an embodiment of an electrowetting display device 1. The display device includes a plurality of electrowetting display elements 2, one of which is shown in the Figure. The lateral extent of the element is indicated in the Figure by the two dashed lines 3, 4. The electrowetting elements comprise a first support plate 5 and a second support plate 6. The support plates may be separate parts of each electrowetting element, but the support plates may be shared in common by the plurality of electrowetting elements. The support plates may be made for instance of glass or polymer and may be rigid or flexible.

The display device has a viewing side 7 on which an image or display formed by the display device can be viewed and a rear side 8. The first support plate 5 faces the viewing side; the second support plate 6 faces the rear side 8. In an alternative embodiment the display may be viewed from the rear side 8. The display device may be of the reflective, transmissive or transflective type. The display may be a segmented display type in which the image is built up of segments. The segments can be switched simultaneously or separately. Each segment includes one electrowetting element 2 or a number of electrowetting elements 2 that may be neighboring or distant. The electrowetting elements included in one segment are switched simultaneously. The display device may also be an active matrix driven display type or a passive matrix driven display.

A cavity, which forms a space 10 between the support plates is filled with two fluids: a first fluid 12 and a second fluid 11. The second fluid is immiscible with the first fluid. The second fluid is electrically conductive or polar, and may be water or a salt solution such as a solution of potassium chloride in a mixture of water and ethyl alcohol. The second fluid may be transparent, but may be colored, white, absorbing or reflecting. The first fluid is electrically non-conductive and may for instance be an alkane like hexadecane or (silicone) oil. A hydrophobic layer 13 is arranged on the support plate 6, creating an electrowetting surface facing the space 10 with a surface area SA. The surface has a minimum area MA for adjoining the second fluid during a display period, as explained further below. The layer may be an uninterrupted layer extending over a plurality of electrowetting elements 2 or it may be an interrupted layer, each part extending only over one electrowetting element 2, as shown in the Figure. The layer may be for instance an amorphous fluoropolymer layer such as AF1600 or another low surface energy polymer. Alternatively the electrowetting element may be constructed with the first liquid 12, the electrode 9, the hydrophobic layer 13 and the walls 16 adjacent the first support plate 5. In this configuration the first liquid is arranged at the viewing side 7 of the space 10 instead of at the rear side 8. Also, in an alternative configuration the electrowetting elements can be positioned on top of each other to include more than one switchable electrowetting elements in series in the optical path. Further integration of the switchable elements can be achieved by including one or more further first fluids in each of the electrowetting element. The hydrophobic character of the layer 13 causes the first fluid to adhere preferentially to the support plate 6 since the first fluid has a higher wettability with respect to the surface of the hydrophobic layer 13 than the second fluid. Wettability relates to the relative affinity of a fluid for the surface of a solid. Wettability increases with increasing affinity, and it can be measured by the contact angle formed between the fluid and the solid and measured internal to the fluid of interest. This increases from relative non-wettability at an angle of more than 90° to complete wettability when the contact angle is 0°, in which case the fluid tends to form a film on the surface of the solid.

Each element 2 includes a first electrode 9 arranged on the second support plate 6. The electrode 9 is separated from the fluids by an insulator, which may be the hydrophobic layer 13. In general, the electrode 9 can be of any desired shape or form. The electrode 9 is supplied with voltage signals by a signal line 14. A second signal line 15 is connected to an electrode which is in contact with the conductive second fluid 11. This electrode may be common to all elements, when they are fluidically interconnected by and share the second fluid, uninterrupted by walls. The electrowetting elements 2 are controlled by a voltage Ve applied between the signal lines 14 and 15. The electrodes 9 on the support plate 6 each are connected to a display driving system by a matrix of printed wiring on the support plate. This wiring can be applied by various methods, such as sputtering and structuring or printing techniques.

In a display of the segment type, the electrode 9 may extend over several elements and define an image region of a plurality of electrowetting elements, which will all be switched simultaneously. When a segment covers several electrowetting elements, the signal line 14 is a common signal line for these electrowetting elements.

The lateral extent of the first fluid 12 is constrained to one electrowetting element by walls 16 that follow the cross-section of the electrowetting element. In the embodiment shown in FIG. 1 the walls define the extent of the hydrophobic layer 13. When the hydrophobic layer extends over a plurality of elements, the walls may be arranged on top of the layer. Alternatively, or additionally, the walls may comprise hydrophilic areas for constraining the first fluid. Further details of the electrowetting elements of the display are known to the skilled person.

The first fluid may absorb at least a part of the optical spectrum. The fluid may be transmissive for a part of the optical spectrum, forming a color filter. For this purpose the fluid may be colored by addition of pigment particles or dye. Alternatively, the first fluid may be black, i.e. absorb substantially all parts of the optical spectrum, or reflecting. The hydrophobic layer may be transparent or reflective. A reflective layer may reflect the entire visible spectrum, making the layer appear white, or part of it, making it have a color.

When the voltage Ve applied between the signal lines 14 and 15 is set at a non-zero signal level of sufficient magnitude the element will enter into an active state. Electrostatic forces will move the second fluid 11 towards the segment electrode 9, thereby pushing away and displacing the first fluid 12 from at least part of the area of the hydrophobic layer 13 towards the walls 16 surrounding the area of the hydrophobic layer. When fully repelled the first fluid is in a drop-like form as schematically indicated by a dashed line 17. This action uncovers the first fluid from the surface of the hydrophobic layer 13 of the electrowetting element. When the voltage across the element is returned to an inactive signal level of zero for sufficient duration, the element will return to an inactive state, where the first fluid flows back to cover the hydrophobic layer 13. In this way the first fluid forms an electrically controllable optical switch in each electrowetting element.

The electrowetting element forms a capacitor. The second fluid 11 and the electrode 9 form the plates and the first fluid 12 and the hydrophobic layer 13 the dielectric layer. When the first fluid is in the active state, i.e. having the form 17, the capacitance of the element is higher than when the first fluid is in the inactive state, i.e. having the form 12.

Figure 2:
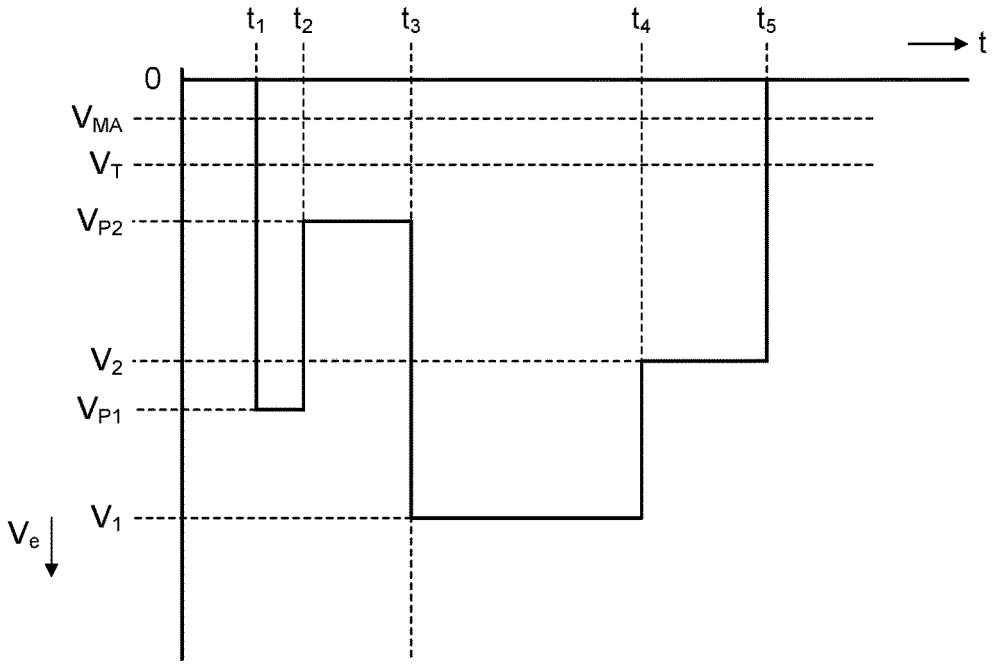
FIG. 2 shows an example of a signal level sequence according to an embodiment.

FIG. 2 shows a graph of the voltage Ve applied between the electrodes 14 and 15 as a function of time t. Although the voltage signal levels indicated are shown as negative voltages, they may also or instead be positive voltages. The Figure shows two periods, a first pre-display period terminating at time t3 for initiating the display element, and a display period starting at time t3 for providing display states, for displaying an image for example.

In the pre-display period in the example of the Figure the applied voltage starts at zero and the display element is in an inactive state, with the first fluid only adjoining the surface, i.e. the transmission is zero. At least one pre-display signal level may be applied during the pre-display period to initiate the display element for the display period. In this example, at time t1 a first pre-display signal level Vp1 is applied followed by a second pre-display signal level Vp2 of lower magnitude. Thus, the first and second pre-display signal levels form a pre-display pulse, in this example a single pre-display signal pulse, although it is envisaged that multiple pulses may be applied.

In order to change the configuration of the fluids from that of the inactive state, a voltage needs to be applied with a signal level exceeding an initiation threshold VT. The signal level of the initiation threshold VT depends on parameters of the construction of the display element, for example the thickness of the hydrophobic layer 13 and/or the thickness of the layer of the first fluid 12. The threshold voltage may for example be 5 volts, or a voltage greater than 5 volts, for example 10 volts, or 15 volts. With a suitable display element construction, the initiation threshold VT may be zero volts, meaning that any non-zero signal level is sufficient for initiation. The threshold voltage may be defined as a percentage of the maximum operating voltage of the display element, for example 15% or greater.

The first pre-display signal level therefore meets or exceeds the initiation threshold VT. Accordingly, the fluids change configuration so the second fluid adjoins the surface as well as the first fluid, thus initiating the display element. Once the initiation threshold VT has been met or exceeded, a voltage may then be applied which is less than the initiation threshold VT but which is sufficient for the second fluid still to adjoin at least the minimum area MA. Thus there is also a voltage threshold for the second fluid to adjoin the minimum area, which is referred to herein as the minimum area voltage threshold VMA. For as long as the applied voltage equals or exceeds this minimum area voltage threshold VMA the second fluid adjoins at least the minimum area MA and the display element remains initiated. However, if the applied voltage is changed so it no longer at least meets the minimum area voltage threshold VMA the display element returns to the off state, where the second fluid no longer adjoins the minimum area MA.

The minimum area may be at least 1%, 5% or 10% of the surface area SA, such that the second fluid adjoins at least 1%, 5% or 10%, respectively, of the surface throughout the display period. When the applied voltage equals the minimum area voltage threshold VMA, the second fluid adjoins the minimum area MA, providing the display element has first been initiated; at a greater magnitude of voltage than the minimum area voltage threshold VMA, and possibly also the initiation threshold VT, the second fluid adjoins greater than the minimum area MA of the surface.

With the second fluid adjoining at least the minimum area MA, the display element is initiated for the display period, by changing a configuration of the display element from an off state with the first fluid but not the second fluid adjoining the surface to a state with the first fluid and the second fluid adjoining part of the surface. This means that hysteresis will not interfere with display states provided during the display period, for the duration that the second fluid remains adjoining at least the minimum area. As will be explained below, a control system of the display device is arranged to configure at least one signal level during the display period such that the second fluid remains adjoining at least the minimum area MA.

Once the display element has been initiated by exceeding the initiation voltage threshold VT, the display element may be switched to any display state where the second fluid adjoins at least the minimum area MA. Thus, numerous grey scale display states may be provided, including those of an applied voltage below the initiation threshold VT. Further, since hysteresis effects are overcome when the display element is initiated, the display state may be changed gradually, in correspondence with a gradual change of applied voltage. This provides much greater control for obtaining a desired display state compared with a display element exhibiting hysteresis which may detrimentally exhibit noticeable jumps between display states despite a gradual change in applied voltage. Further, this allows a desired display state to be reliably provided regardless of whether the applied voltage follows a greater or a lower applied voltage and regardless of the voltage that was applied to the display element in the previous display state.

Referring still to FIG. 2, at time t3 a first display signal level V1 is applied, to change the fluid configuration to provide a first display state of the display period. The first display signal level may be less than or greater than the second pre-display signal level VP2, and may be greater than a maximum operating voltage for the display period. At time t4 a second display signal level V2 is applied to obtain a second display state of the display period. The first and second display signal levels at least meet the minimum area voltage threshold VMA. At time t5 a zero signal level is applied, and the display element returns to the inactive state, thereby ending the display period. It is to be understood that during the display period the display element may instead be driven to more than two different display states with appropriate signal levels which at least meet the minimum area voltage threshold VMA.

Figure 3:
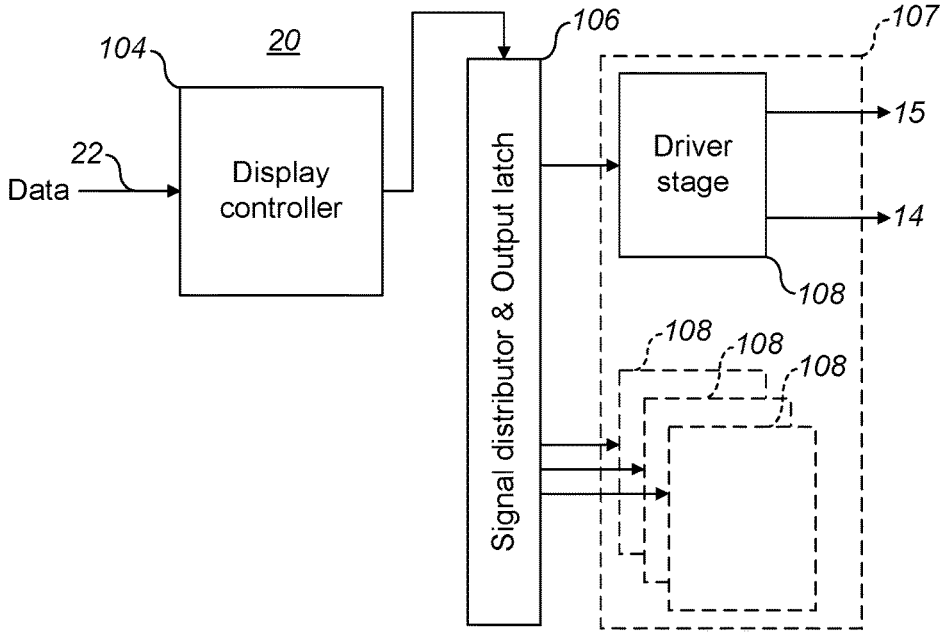
FIG. 3 shows a configuration for driving an electrowetting display element.

FIG. 3 shows a diagrammatic view of an embodiment of an electrowetting display driving system, including a control system of the display device. The display driving system is of the so-called direct drive type and may be in the form of an integrated circuit adhered to the support plate 6. An active matrix type display may also use such a display driving system. The display driving system 20 includes control logic and switching logic, and is connected to the display by means of signal lines 14 and a common signal line 15. Each electrode signal line 14 connects an output from the display driving system 20 to a different electrode 9, respectively. The common signal line is connected to the second, conductive fluid 11 through an electrode. Also included are one or more input data lines 22, whereby the display driving system can be instructed with data so as to determine which elements should be in an active state and which elements should be in a non-active state at any moment of time.

The embodiment of the controller shown comprises a display controller, 104, e.g. a microcontroller, receiving input data from the input data lines 22 relating to the image to be displayed. The microcontroller, being in this embodiment the control system, is arranged for applying a voltage to the first electrode to provide a fluid configuration, for example a display state, in response to a signal level of the voltage. The microcontroller controls a timing and/or a signal level of at least one signal level for a display element, including during the display period so the at least one signal level is configured throughout the display period such that the second fluid adjoins at least the minimum area MA. Thus, the control system is arranged to configure the signal level throughout the display period such that the second fluid adjoins at least the minimum area. Therefore, in certain embodiments, for any input data which would result in the second fluid adjoining less than the minimum area MA during the display period, the microcontroller outputs a signal level corresponding at least to the minimum area voltage threshold VMA. Further, the microcontroller system may be arranged to control the timing and/or signal level of the at least one pre-display signal level so that initiating the display element for the display period is imperceptible to a viewer of the display element.

The output of the microcontroller is connected to the data input of a signal distributor and data output latch 106. The signal distributor distributes incoming data over a plurality of outputs connected to the display device, via drivers in examples. The signal distributor causes data input indicating that a certain element is to be set in a specific display state to be sent to the output connected to this element. The distributor may be a shift register. The input data is clocked into the shift register and at receipt of a latch pulse the content of the shift register is copied to the output latch. The output latch has a one or more outputs, connected to a driver assembly 107. The outputs of the latch are connected to the inputs of one or more driver stages 108 within the driving system. The outputs of each driver stage are connected through the signal lines 14 and 15 to a corresponding display element. In response to the input data a driver stage will output a voltage of the signal level set by the microcontroller to set one of the elements in a corresponding display state.

Figure 4:
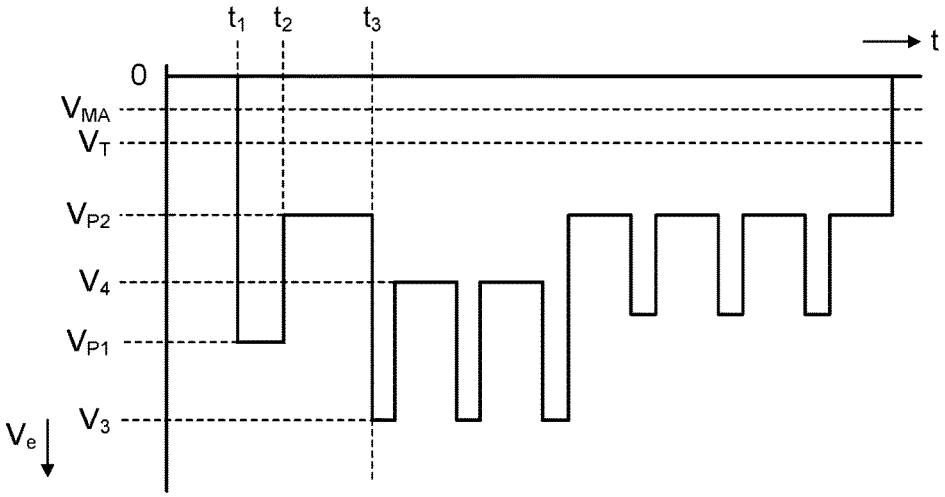
FIGS. 4 to 6 show further example signal level sequences according to further embodiments.

With reference to FIG. 2, the driving scheme during the display period is an analogue driving scheme. Alternative driving schemes are envisaged. For example, with reference to FIG. 4, a semi-analogue scheme (analogue with pulse width modulation (PWM)) is illustrated. In a semi-analogue scheme, the grey scale display state is determined by a combination of the amplitude of the voltages and the length of time that each voltage is applied for. The signal levels applied during the pre-display period are the same as those described for FIG. 2. During the display period, the display states are provided using semi-analogue voltage signal levels, as is well known in the art. For the first display state, the signal level V4 is mixed in time with the signal level V3. For the second display state, different signal levels are mixed in time. Thus, the pulse amplitude may be modulated also. Whilst FIG. 4 shows two display states during the display period, it is of course understood that the display period may provide any number of display states, provided that the second fluid remains adjoining at least the minimum area MA. Also, it will be appreciated for the embodiments described with FIG. 4 that a pulse width modulation scheme may be applied during the display period instead.

Figure 5:
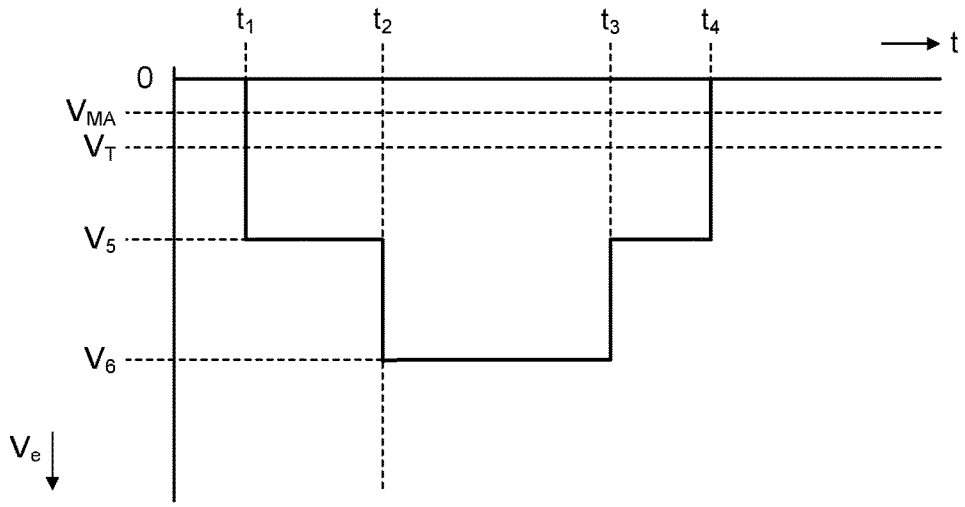

FIG. 5 shows an alternative analogue driving scheme. In this embodiment the pre-display period ends at time t2 and the display period starts at time t2. At time t1 a single pre-display signal level exceeding the initiation threshold VT, is applied to change the fluids from the inactive state to a first pre-display state. This initiates the display element. At time t2 a first display signal level is applied, different from the pre-display signal level, to provide the first display state. At time t3 a second display signal level is applied, to provide a second display state. The first and second display signal levels at least meet the minimum area voltage threshold VMA. At t4 a zero signal level is applied thereby ending the display period, but it is envisaged that further display signal levels which at least meet the minimum area voltage threshold VMA may be applied during the display period.

Figure 6:
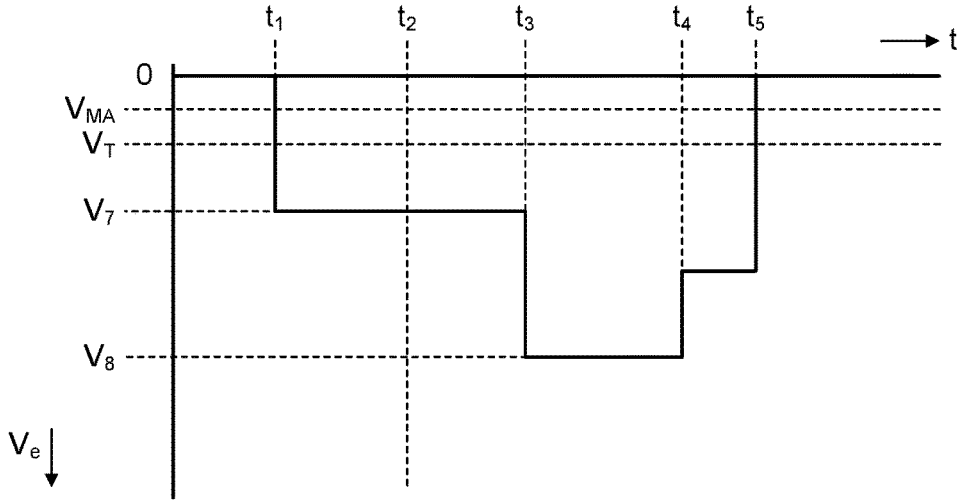

FIG. 6 shows a further alternative analogue driving scheme. The pre-display period ends at time t2 and the display period starts at time t2. In this embodiment a single pre-display signal level V7 is applied which corresponds with the signal level required for the initial display state in the display period. This avoids re-addressing the display element at time t2. At time t3 the signal level V8 is applied to provide the second display state. At time t4 a further display state is provided, followed by a zero signal level at time t5. Alternatively, further display states may be provided after time t5. For each display state the applied voltage at least meets the minimum area voltage threshold VMA.

It will be appreciated that for the embodiments described using FIGS. 5 and 6, a pulse width modulation scheme, or a semi-analogue scheme may be applied during the display period instead.

Figure 7:
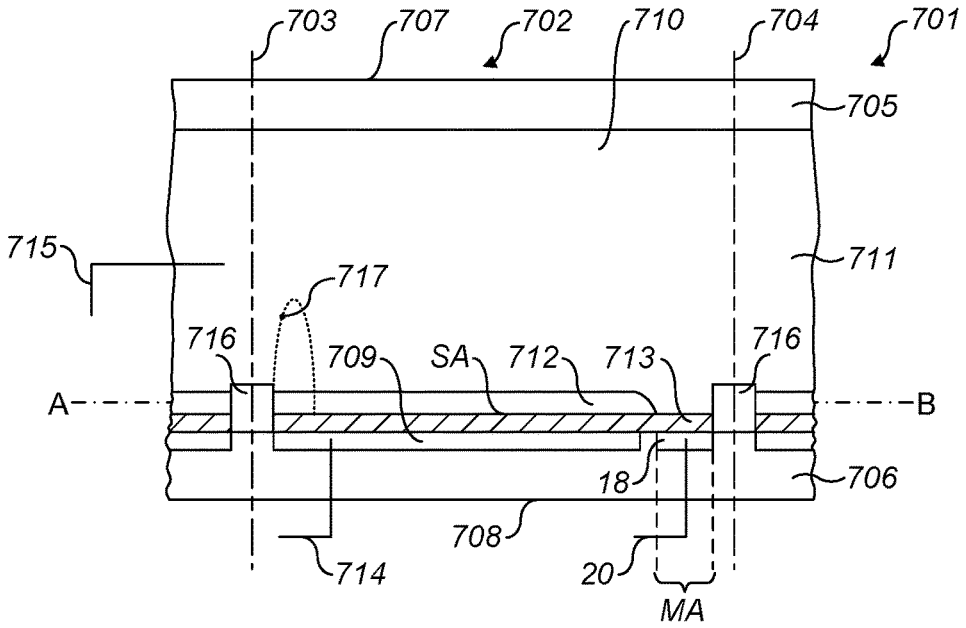
FIGS. 7 and 8 show schematically an alternative display element.
Figure 8:
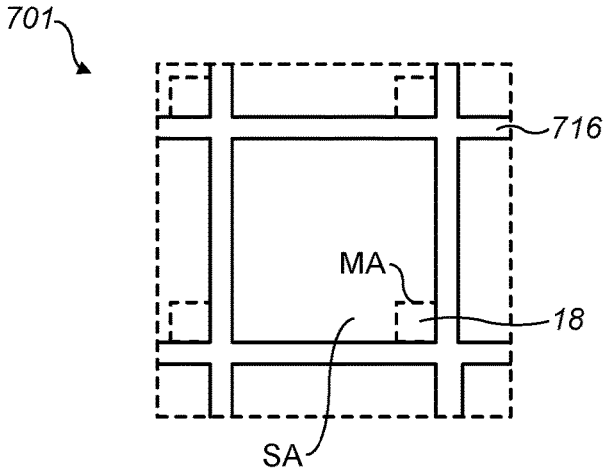

FIGS. 7 and 8 show schematically an alternative display element. FIG. 8 shows a cross section of the element shown in FIG. 7, taken along line A-B. A second electrode 18 is indicated with a dashed line, its extent representing the minimum area MA. Features are similar to those described previously with reference to FIG. 1 and are labelled with the same reference numerals incremented by 700; corresponding descriptions should be taken to apply here also.

In this embodiment, the display element 701 comprises a second electrode 18 for applying a voltage to the fluids 711, 712. The second electrode is a separate electrode from the first electrode 709 and is electrically insulated therefrom such that a voltage applied to the first electrode does not interfere with a voltage applied to the second electrode, and vice versa.

Similarly as the first electrode, the second electrode 18 is arranged on the second support plate 706, and is separated from the fluids by an insulator, in this example the hydrophobic layer 113. In contrast to the embodiment described using FIG. 1, the first electrode 709 has an extent less than the surface area SA of the hydrophobic layer 713. The second electrode 18 has an extent corresponding with the minimum area MA of the hydrophobic layer 713, as illustrated. Whilst the second electrode is shown in this embodiment as square in form, it is to be appreciated that other forms are possible, for example triangular or quarter circular. Further, the second electrode may be positioned other than in the corner of the surface area SA. For example, the second electrode may be positioned in the center of the surface area SA, or along at least part of a wall 716. The form of the first electrode may be adapted appropriately to tessellate with the second electrode as closely as possible, whilst maintaining sufficient insulation there between to provide for smooth movement of the fluids across the hydrophobic surface 113.

The second electrode 18 is supplied with voltage signals by a signal line 20 connected to the display driving system via printed wiring on the support plate. The control system is arranged to apply during the pre-display period the at least one pre-display signal level to the second electrode 18, and during the display period the at least one display signal level to the first electrode 709. Throughout at least part of the display period the control system may apply a non-zero signal level to the second electrode 18 such that the display element is initiated throughout the display period. The non-zero signal should equal or exceed the minimum area voltage threshold VMA, once the display element has been initiated by first applying to the second electrode a voltage meeting or exceeding the initiation voltage threshold VT; in this way the non-zero signal level is configured so the first and second fluids adjoin the surface throughout the display period, the second fluid adjoining at least the minimum area MA. If after initiation the signal level applied to the first electrode 709 exceeds the minimum area voltage threshold VMA, a signal level below the minimum area voltage threshold VMA, for example a zero signal level, may be applied to the second electrode 18 since the display signal level on the first electrode maintains the initiation.

As explained above, it will be appreciated that with the display element initiated, with the second fluid adjoining at least the minimum area MA, radiation (i.e. light) will pass through the minimum area MA. Accordingly, where the first fluid is absorbing, for example, the inactive state, being the darkest display state of the display element, and any display states resulting from a below minimum area voltage threshold voltage, are not available during the display period. Thus, to improve the contrast-ratio of the display element, the display element may be arranged to reduce passage of radiation through the minimum area MA. For example, a layer adjacent the minimum area MA may be provided for absorbing radiation, for example all wavelengths, or at least those in the visible spectrum. The absorbing layer may be the second electrode 18, by forming the second electrode 18 from a material with, for example, a high radiation absorbance. Further details are known to the skilled person.

In such embodiments where the display element is arranged to reduce the passage of light through the minimum area MA, for dark grey levels the voltage change required to switch between two different greyscale display states may be larger than the voltage change for switching between the same two greyscale display states of a display element arranged to give no reduction in the passage of light through the minimum area MA. This is because, for the electro-optic curve plotting the light transmission against the required voltage for a display element, the gradient of the curve for greyscale display states is shallower for a display element arranged to reduce the passage of light through the minimum area MA compared with a steeper curve gradient for the same greyscale display states of the electro-optic curve of a display element arranged to give no reduction in light passing through the minimum area MA. Accordingly, for a display element arranged to reduce light passing through the minimum area MA, darker greyscale display states can be obtained more easily and with a larger distance between the voltages required compared with a display element arranged to give no reduction in light through the minimum area MA. Thus, a more gradual and controllable transition between different greyscale display states may be obtained, with a wider voltage range to give the range of available greyscale states, compared with a display element with a steeper electro-optic curve gradient. In addition, for such embodiments of a display element arranged to reduce light passing through the minimum area MA, the wider voltage range means that when a certain voltage is applied to multiple display elements of the display device the grey levels of the display elements are less sensitive to non-uniformities in pixel parameters such as oil volume, dielectric thickness or pixel wall height, than the grey levels of display elements arranged to give no reduction of light through the minimum area MA. The latter display elements have a steeper electro-optic curve and are therefore more sensitive to non-uniformities in pixel parameters.

Additionally, or alternatively, the minimum area MA may be located at a part of the surface which is outside of a display area of the surface for providing display effects, to improve the contrast-ratio. In another embodiment, for instance in the case that the display is operated in a reflective mode, the electrode corresponding with the minimum area MA can be made of a transparent material, such as ITO, to create an effective black mask as no light is reflected to the viewer.

In another embodiment, a display device may use color filters for imparting color in radiation passing through the display. For example, the display may comprise at least one group of four display elements: one display element for providing white light and the other three arranged with a color filter for providing a different one of red, green and blue primary light colors. Thus, the group forms a full color display pixel, with the white element being for controlling brightness, and providing a greater maximum brightness. The method may be applied to the red, green and blue display elements, so they remain initiated during the display period. However, the method may not be applied for the white display element. Thus, the white element may provide a display state with only the first fluid adjoining the surface during the display period. Thus, by driving at least one display element in this way, in combination with driving at least one display element to provide the inactive display state during the display period, a display pixel may provide darker display states, including a darker black state, than if all elements in the group were driven in this way. For this example, rendering and/or addressing algorithms well known in the art, for example dithering techniques, may be applied to the white element to compensate for hysteresis effects.

Embodiments have been explained above with reference to one display element. As will be appreciated, the electrowetting display device comprises a plurality of display elements, and the control system may be arranged to apply the method to more than one, and in some embodiments, all display elements. This is achieved by the first electrodes of at least two of the display elements being electrically connected to the control system, for example via the matrix. For the embodiments described using FIGS. 7 and 8, the first electrodes of each display element may be electrically connected via the matrix to the control system and, separately, the second electrodes may be electrically connected via a separate matrix to the control system, allowing for independent control of the first and second sets of electrodes. The second electrodes of a group of display elements may be bussed together, for example as a row, so the group may be initiated simultaneously by a single driver or a single output of a driver. The display device, including the control system, may be arranged to initiate display elements of the display device individually, or to initiate a plurality of display elements, for example at least one line (a row or a column) of display elements (which may be synchronous with line scanning of the display), a group of display elements, and/or all of the display elements of the display device (which may not require line scanning). Thus the control system may initiate simultaneously more than one display element, for example all of the display elements of the display device simultaneously. Such an initiation of all elements may be performed when power for the display device is switched on, so that all display elements are then ready for the display period. Their initiation can then be maintained throughout the display period.

In further embodiments, the display device comprises at least one test structure, the display device being arranged to initiate at least one display element using the at least one test structure. At least one test structure may be provided at the edge of a display device of a matrix of display elements, for testing the device for correct operation using at least one test signal. Depending on the construction, the test structure may be arranged to test all display elements of the device, and/or all odd and/or evenly numbered lines. Accordingly, initiation of the display elements may be provided using the test structures, to initiate all display elements, or odd and/or even lines of display elements simultaneously.

It is envisaged that embodiments may include a memory store for storing data indicative of the display states provided on each display element. The display state history for each display element may therefore be logged. Using this data the control system can for example identify any display element(s) in an inactive state, and initiate that display element(s) ready for providing a display state.

All display elements may be initiated simultaneously for each display period; i.e. at one moment in time. This avoids initiating some display elements at one moment in time, and initiating other display elements at a different moment in time. This therefore minimizes the number of moments in time at which at least one display element is initiated, which may reduce power consumption and any resulting front of screen effects. As a special example, the front of screen effects caused by initiation could be limited by applying two short pre-display pulses of for example 5 volts to all display elements, compared with a single pre-display pulse of 5 volts of longer duration. In one example, these short pre-display pulses would each be 1 millisecond long, or less. Further, pre-display signal levels are set as low as possible, whilst meeting the initiation threshold VT, to reduce power consumption. Further, a scheme of pre-display signal levels with a minimum number of addressing actions may avoid complex schemes requiring rapid re-addressing of the display elements and therefore higher frame rates.

The above embodiments are to be understood as illustrative examples. Further embodiments are envisaged. For example, whilst the above embodiments have been described using a DC scheme, further embodiments are envisaged using an AC scheme. The signal level schemes described above should be understood as exemplary; further schemes are envisaged within the scope of the appended claims. For example, during the pre-display period and/or display period, other signal level schemes may be applied, for example a reset signal to reduce backflow. Further, a sequence of analogue and pulse width modulated pulses may be applied during the display period; for example, analogue signals may be used for brighter grey scales whilst pulse width modulated signals may be used for darker grey scales. It is envisaged that each display element may be subjected to a repeating sequence of a pre-display period followed by a display period, which may not align in time with each other for each display element; i.e. one display element may exist in the pre-display period whilst another element exists in the display period. Alternatively, each display element may be initiated at the start of each frame. Embodiments have been described where a voltage is applied between the first electrode, in some embodiments also the second electrode, and the electrode in contact with the second fluid. In other embodiments the voltage may be applied between the first electrode, in certain embodiments also the second electrode, and a common electrode of the display device other than the second fluid contacting electrode.

It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the accompanying claims.

What is claimed is:

1. A method of controlling an electrowetting element, the method comprising:

receiving first data indicative of a first display effect;

using the first data, determining a first magnitude of a first voltage;

generating the first voltage with the first magnitude;

applying the first voltage to the electrowetting element;

receiving second data indicative of a second display effect different from the first display effect;

using the second data, determining a second magnitude of a second voltage, the second magnitude equal to the first magnitude;

generating the second voltage with the second magnitude; and applying the second voltage to the electrowetting element.

2. The method according to claim 1, wherein a first brightness of the first display effect is greater than a second brightness of the second display effect.

3. The method according to claim 1, comprising:

receiving third data indicative of a third display effect, a third brightness of the third display effect greater than a first brightness of the first display effect;

using the third data, determining a third magnitude of the third voltage, the third magnitude larger than the first magnitude;

generating the third voltage with the third magnitude; and applying the third voltage to the electrowetting element.

4. The method according to claim 1, comprising:

receiving fourth data indicative of a fourth display effect, a first brightness of the first display effect greater than a fourth brightness of the fourth display effect;

using the fourth data, determining a fourth magnitude of the fourth voltage, the fourth magnitude substantially equal to the first magnitude;

generating the fourth voltage with the fourth magnitude; and applying the fourth voltage to the electrowetting element.

5. The method according to claim 1, wherein the determining the second magnitude of the second voltage comprises determining that a value corresponding to the second data is less than a threshold value.

6. The method according to claim 5, wherein the threshold value corresponds to a voltage value for application to the electrowetting element for switching a first fluid of the electrowetting element and a second fluid of the electrowetting element, the first fluid substantially immiscible with the second fluid, from a first configuration substantially without the second fluid adjoining a surface of a support plate of the electrowetting element to a second configuration with the second fluid in contact with a portion of the surface.

7. The method according to claim 1, comprising:

before the applying the first voltage to the electrowetting element, applying a zero voltage to the electrowetting element such that a first fluid of the electrowetting element and a second fluid of the electrowetting element, the first fluid substantially immiscible with the second fluid, are in a configuration substantially without the second fluid adjoining a surface of a support plate of the electrowetting element, wherein the first magnitude of the first voltage is a non-zero magnitude.

8. The method according to claim 1, wherein the first display effect corresponds to a configuration of a first fluid of the electrowetting element and a second fluid of the electrowetting element, the first fluid substantially immiscible with the second fluid, with the second fluid in contact with at least: 1%, 5% or 10% of a surface of a support plate of the electrowetting element.

9. The method according to claim 1, wherein the applying the second voltage comprises applying the second voltage as a direct current voltage.

10. The method according to claim 1, wherein at least one of: the applying the first voltage or the applying the second voltage, is between a first electrode of the electrowetting element and a second fluid of the electrowetting element, the electrowetting element further comprising a first fluid substantially immiscible with the second fluid.

11. The method according to claim 1, wherein:

the applying the first voltage comprises applying the first voltage between a first electrode of the electrowetting element and a second fluid of the electrowetting element, the electrowetting element further comprising a first fluid substantially immiscible with the second fluid, and the applying the second voltage comprises applying the second voltage between a second electrode of the electrowetting element and the second fluid.

12. The method according to claim 1, wherein:

the applying the first voltage comprises applying the first voltage between a first electrode of the electrowetting element and a second fluid of the electrowetting element, the electrowetting element further comprising a first fluid substantially immiscible with the second fluid;

the applying the second voltage comprises applying the second voltage between a second electrode of the electrowetting element and the second fluid; and the first display effect corresponds to a configuration of the first fluid and the second fluid, with the second fluid adjoining a portion of a surface of a support plate of the electrowetting element, the portion of the surface substantially corresponding to an extent of the second electrode.

13. A device comprising:

an electrowetting element comprising:

a first support plate;

a second support plate;

a first fluid; and a second fluid substantially immiscible with the first fluid, the first fluid and the second fluid located between the first support plate and the second support plate; and a control system operable to:

receive first data indicative of a first display effect;

using the first data, determine a first magnitude of a first voltage;

generate the first voltage with the first magnitude;

apply the first voltage to the electrowetting element;

receive second data indicative of a second display effect different from the first display effect;

using the second data, determine a second magnitude of a second voltage, the second magnitude equal to the first magnitude;

generate the second voltage with the second magnitude; and apply the second voltage to the electrowetting element.

14. The device according to claim 13, wherein the first support plate comprises a first electrode and a second electrode, the control system further operable to:

apply the first voltage between the first electrode and the second fluid; and apply the second voltage between the second electrode and the second fluid.

15. The device according to claim 13, wherein:

the first support plate comprises a first electrode and a second electrode, and the first display effect corresponds to a configuration of the first fluid and the second fluid with the second fluid in contact with a portion of a surface of the first support plate, the portion of the surface substantially corresponding to an extent of the second electrode, the control system further operable to:

apply the first voltage between the first electrode and the second fluid; and apply the second voltage between the second electrode and the second fluid.

16. The device according to claim 15, wherein the second electrode is substantially absorbing for radiation in the visible spectrum.

17. The device according to claim 15, comprising a layer substantially absorbing for radiation in the visible spectrum, the layer located to substantially overlap the portion of the surface of the first support plate.

18. The device according to claim 13, wherein the control system comprises:

a display controller operable to:

receive the first data;

using the first data, determine the first magnitude of the first voltage;

receive the second data; and using the second data, determine the second magnitude of the second voltage; and a driver stage operable to:

generate the first voltage with the first magnitude;

apply the first voltage to the electrowetting element;

generate the second voltage with the second magnitude; and apply the second voltage to the electrowetting element.

19. A method of controlling an electrowetting element, the method comprising:

receiving first data indicative of a first display effect; and using the first data to:

determine a first magnitude of a first voltage;

generate the first voltage with the first magnitude;

apply the first voltage to the electrowetting element;

determine a second magnitude of a second voltage, the second magnitude larger than zero volts and smaller than the first magnitude;

generate the second voltage with the second magnitude; and apply the second voltage to the electrowetting element.

20. The method according to claim 19, comprising:

before the applying the first voltage to the electrowetting element, applying a zero voltage to the electrowetting element such that a first fluid of the electrowetting element and a second fluid of the electrowetting element, the first fluid substantially immiscible with the second fluid, are in a configuration substantially without the second fluid adjoining a surface of a support plate of the electrowetting element, wherein the first magnitude of the first voltage is a non-zero magnitude.

21. The method according to claim 19, wherein the second magnitude of the second voltage is for switching a first fluid of the electrowetting element and a second fluid of the electrowetting element, the first fluid substantially immiscible with the second fluid, from a first configuration with the second fluid in contact with a first portion of a surface of a support plate of the electrowetting element to a second configuration with the second fluid in contact with a second portion of the surface smaller than the first portion.

22. A device comprising:

an electrowetting element comprising:

a first support plate;

a second support plate;

a first fluid; and a second fluid substantially immiscible with the first fluid, the first fluid and the second fluid located between the first support plate and the second support plate;

a control system operable to:

receive first data indicative of a first display effect; and using the first data to:

determine a first magnitude of a first voltage;

generate the first voltage with the first magnitude;

apply the first voltage to the electrowetting element;

determine a second magnitude of a second voltage, the second magnitude larger than zero volts and smaller than the first magnitude;

generate the second voltage with the second magnitude; and apply the second voltage to the electrowetting element.

23. The device according to claim 22, wherein the control system is further operable to:

before applying the first voltage to the electrowetting element, apply a zero voltage to the electrowetting element such that the first fluid and the second fluid are in a configuration substantially without the second fluid adjoining a surface of the first support plate, wherein the first magnitude of the first voltage is a non-zero magnitude.

24. The device according to claim 22, wherein the second magnitude of the second voltage is for switching the first fluid and the second fluid from a first configuration with the second fluid in contact with a first portion of a surface of the first support plate to a second configuration with the second fluid in contact with a second portion of the surface smaller than the first portion.

* * * * *